US009114855B2

(12) United States Patent
Nemeth

(10) Patent No.: US 9,114,855 B2
(45) Date of Patent: Aug. 25, 2015

(54) FOLDING ARCH WITH LOCK AND LIFT ASSIST

(71) Applicant: Xtreme Marine Corporation, Maryville, TN (US)

(72) Inventor: Bradley Michael Nemeth, Oak Ridge, TN (US)

(73) Assignee: Xtreme Marine Corporation, Maryville, TN (US)

( * ) Notice: Subject to any disclaimer, the term of this patent is extended or adjusted under 35 U.S.C. 154(b) by 0 days.

(21) Appl. No.: 14/207,960

(22) Filed: Mar. 13, 2014

(65) Prior Publication Data

US 2014/0261144 A1 Sep. 18, 2014

Related U.S. Application Data

(60) Provisional application No. 61/791,641, filed on Mar. 15, 2013.

(51) Int. Cl.
*B63B 17/02* (2006.01)

(52) U.S. Cl.
CPC ..... *B63B 17/02* (2013.01)

(58) Field of Classification Search
CPC ..... B63B 17/02
USPC ..... 114/361
See application file for complete search history.

(56) References Cited

U.S. PATENT DOCUMENTS

| | | | | |
|---|---|---|---|---|
| 4,926,782 | A * | 5/1990 | Lacy | 114/361 |
| 5,918,613 | A * | 7/1999 | Larson | 135/88.01 |
| 6,026,761 | A * | 2/2000 | Parniske et al. | 114/343 |
| 6,209,477 | B1 * | 4/2001 | Biedenweg | 114/361 |
| 6,257,261 | B1 * | 7/2001 | Johnson | 135/96 |
| 6,327,993 | B1 * | 12/2001 | Richens, Jr. | 114/361 |
| 6,666,159 | B2 * | 12/2003 | Larson et al. | 114/253 |
| 6,691,637 | B1 * | 2/2004 | Smith et al. | 114/361 |
| 6,755,332 | B2 * | 6/2004 | Crane et al. | 224/321 |
| 6,799,529 | B1 * | 10/2004 | Willis | 114/361 |
| 6,983,716 | B1 * | 1/2006 | Ankney et al. | 114/361 |
| 7,438,015 | B1 * | 10/2008 | Schwindaman | 114/361 |
| 7,895,964 | B2 * | 3/2011 | Russikoff | 114/361 |
| 7,950,342 | B2 * | 5/2011 | Russikoff | 114/361 |
| 8,025,194 | B2 * | 9/2011 | Jesewitz | 224/406 |
| 8,297,484 | B2 * | 10/2012 | Jesewitz et al. | 224/406 |
| 8,567,651 | B2 * | 10/2013 | Jesewitz | 224/406 |
| 8,752,498 | B1 * | 6/2014 | Schwindaman et al. | 114/361 |
| 2005/0194414 | A1 * | 9/2005 | Lynch | 224/401 |
| 2014/0261143 | A1 * | 9/2014 | Williams et al. | 114/361 |
| 2014/0261144 | A1 * | 9/2014 | Nemeth | 114/361 |

* cited by examiner

*Primary Examiner* — Lars A Olson
*Assistant Examiner* — Jovon Hayes
(74) *Attorney, Agent, or Firm* — Luedeka Neely Group, P.C.

(57) ABSTRACT

A folding arch system for a boat includes an arch member pivotally connected to a boat hull and pivotally positionable relative to the boat hull between a raised position and a lowered position. A lateral support is pivotally connected to the vertical arch. A rigid canopy is pivotally connected to the arch member and yieldably coupled to the lateral support. The vertical arch member and the lateral support supportably position the rigid canopy in a predetermined horizontal orientation.

7 Claims, 13 Drawing Sheets

FOLDING ARCH WITH LOCK AND LIFT ASSIST

CROSS-REFERENCE TO RELATED APPLICATION

This application claims priority to U.S. Provisional Application Ser. No. 61/791,641 filed Mar. 15, 2013, entitled Folding Arch With Lock And Lift Assist, incorporated by reference herein in its entirety.

FIELD

This disclosure relates to arch structures for boats. More particularly, the disclosure relates to a folding arch having a lock and lift assist and that can be oriented in a plurality of positions.

BACKGROUND

Boat arches are used for a variety of purposes. Arches are used to provide an elevated location for a tow point for wakeboarding. Arches are also used to provide a structure for locating a covering material for protection from the elements. Arches may also be used as a site for storing cargo such as skis, wakeboards, and the like, and as a site for locating equipment such as speakers, horns, lights, antennas, and the like. Arches are also used for decorative purposes.

Commonly, arches are of fixed orientation construction due to the strength required of arches. This is undesirable for storing and transporting boats, as the arch structure is cumbersome. Also, such arches have no ability to provide different arch heights or configurations. What is desired is an arch construction that enables a sufficiently strong structure, yet a structure that can be provided in orientations other than fully erected.

The disclosure advantageously provides folding boat arch systems that can be erected in various orientations, while maintaining a covering canopy.

SUMMARY

The disclosure relates to a folding arch system for a boat.

In one aspect of the disclosure, the folding arch system includes an arch member pivotally connected to a boat hull and pivotally positionable relative to the boat hull between a raised position and a lowered position. A lateral support is pivotally connected to the vertical arch. A rigid canopy is pivotally connected to the arch member and yieldably coupled to the lateral support. The vertical arch member and the lateral support supportably position the rigid canopy in a predetermined horizontal orientation.

The arch system is raised by raising the vertical arch and lowered by lowering the vertical arch. The canopy is substantially maintained by the arch member and the lateral support in the predetermined horizontal orientation when the arch system is in a raised orientation, a lowered orientation, and orientations there between.

The arch system may incorporate locks to maintain the arch system in a desired orientation, as wells as springs or motors to assist in raising and lowering of the arch.

The arch system advantageously maintains the canopy as a covering roof structure despite the elevation of the canopy.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
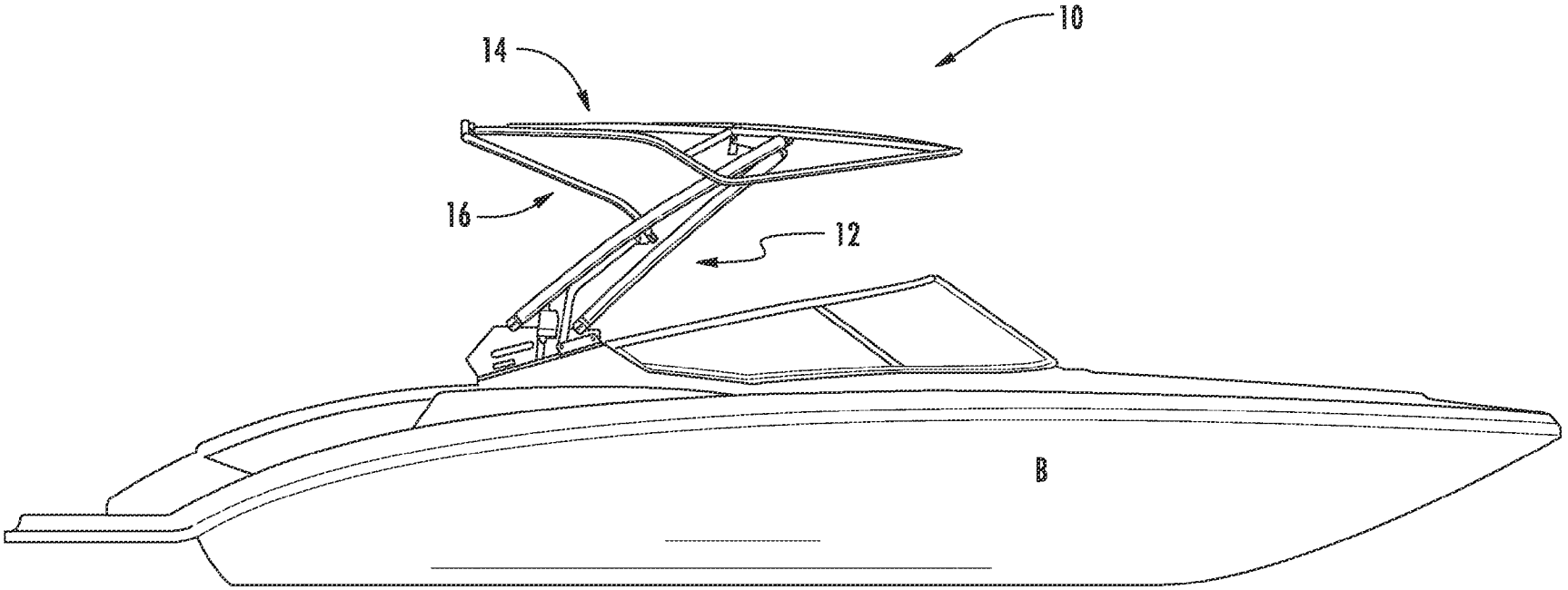
FIGS. 1 and 2 show a folding arch according to the disclosure mounted on a boat hull and oriented in a high position.
Figure 2:
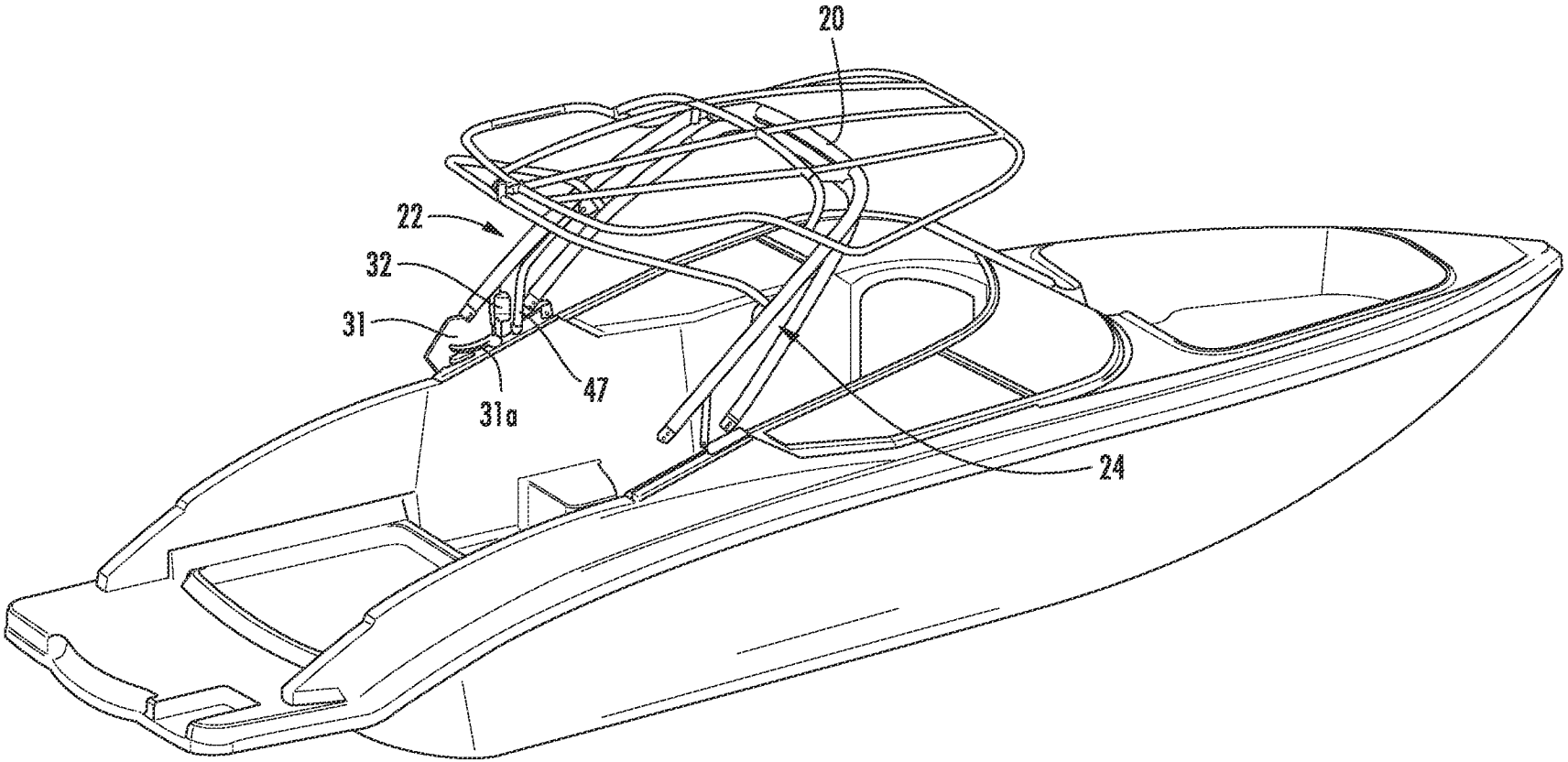
Figure 3:
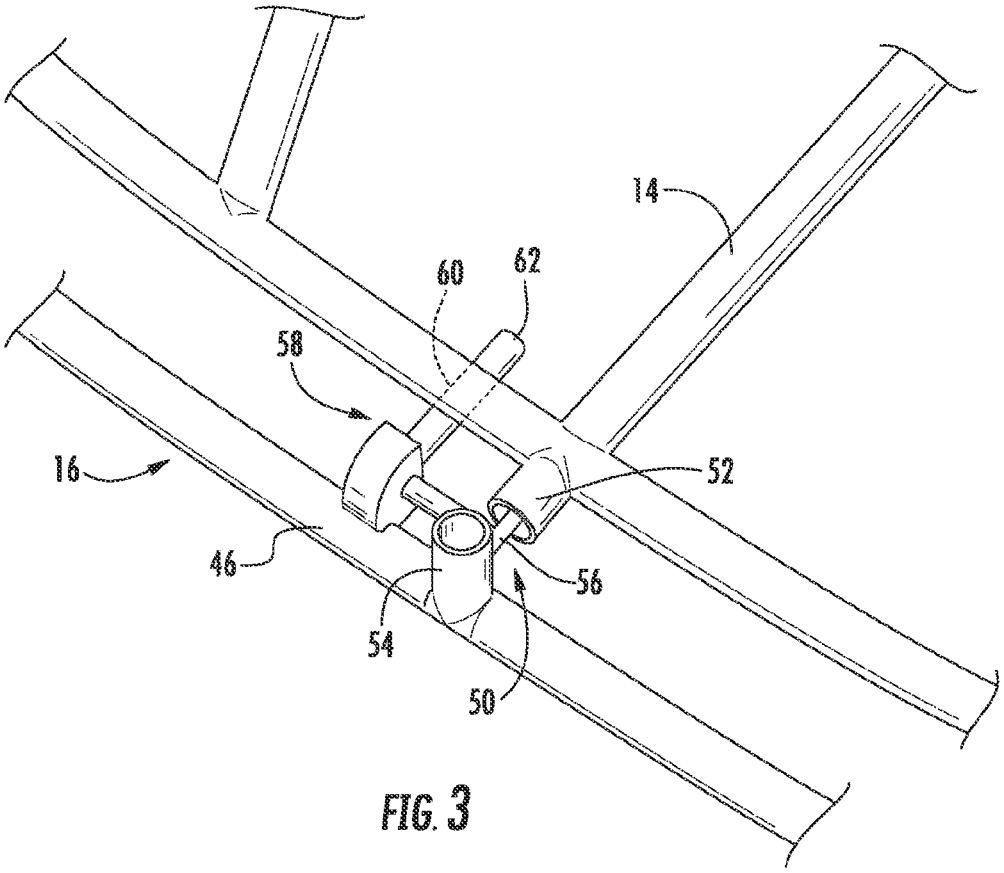
FIG. 3 is an enlargement of a portion of FIG. 2.
Figure 4:
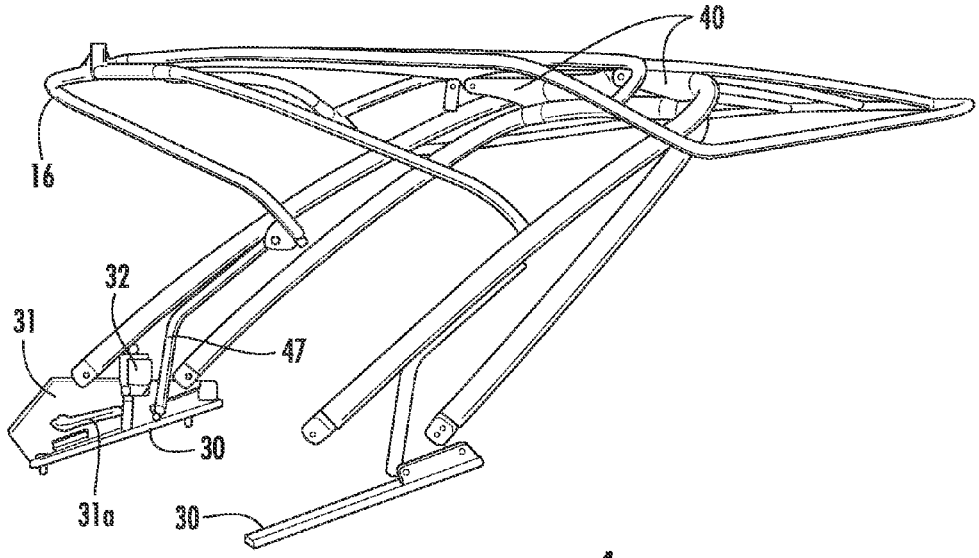
FIGS. 4 and 5 show the arch of FIG. 1 oriented in a high position.
Figure 5:
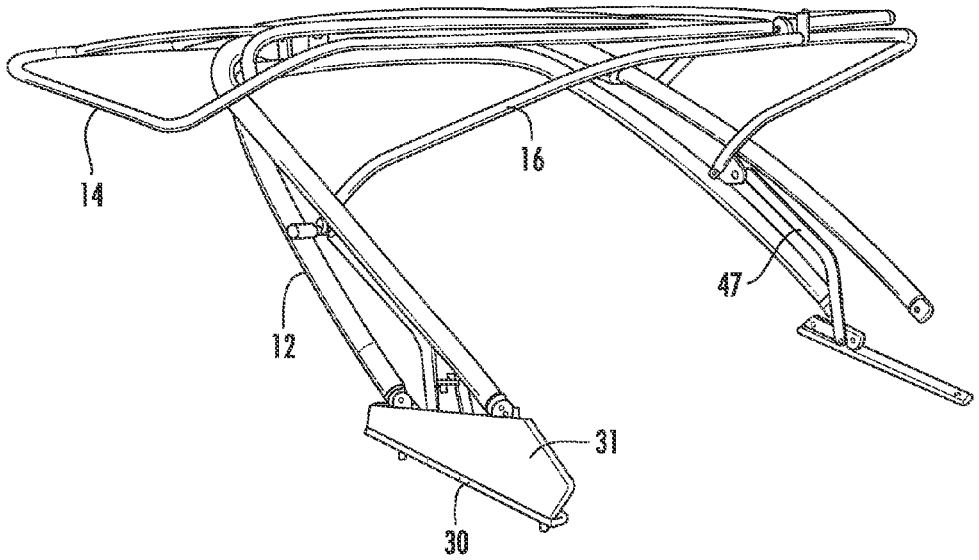
Figure 6:
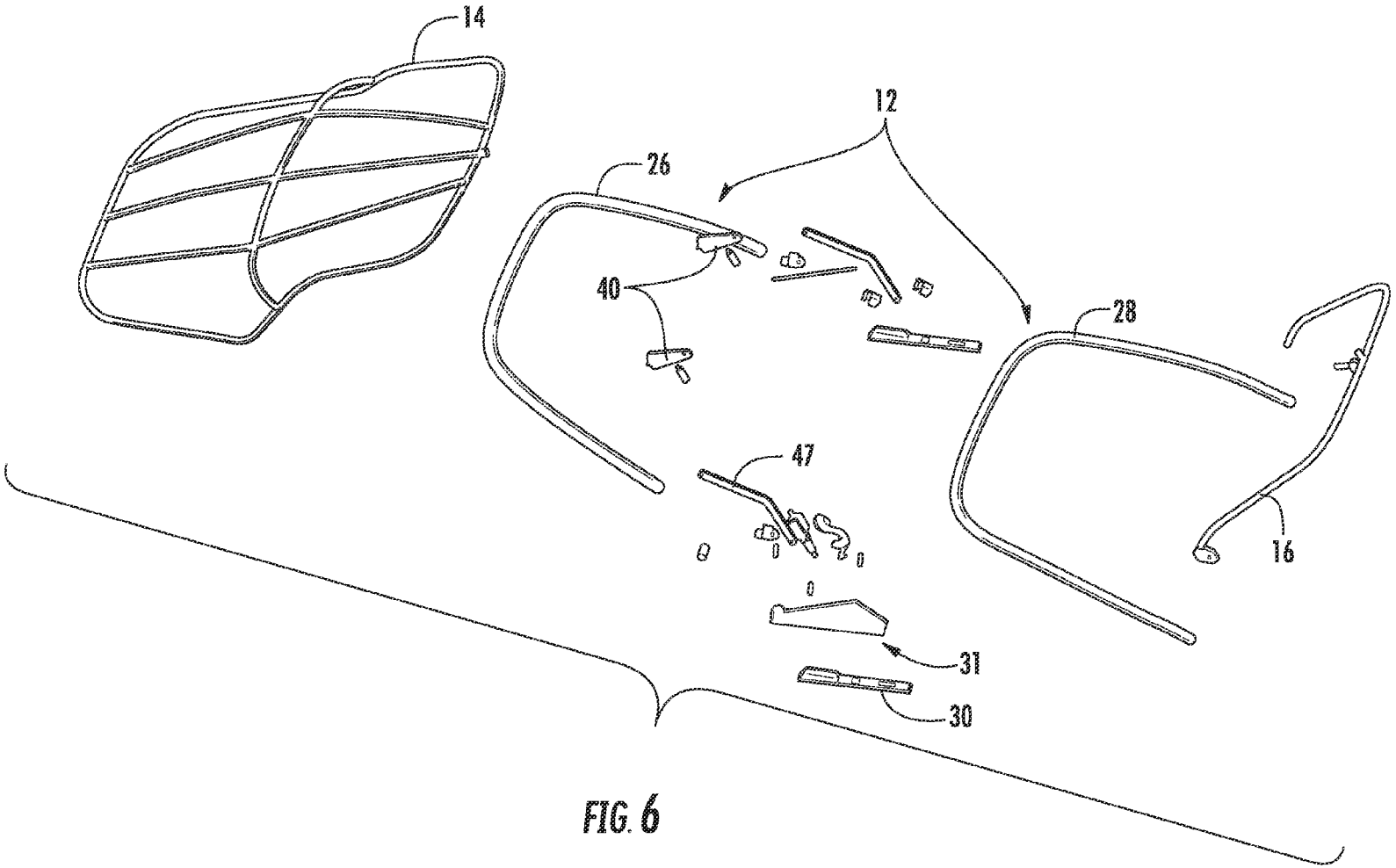
FIGS. 6 and 7 are exploded views of the arch of FIG. 1.
Figure 7:
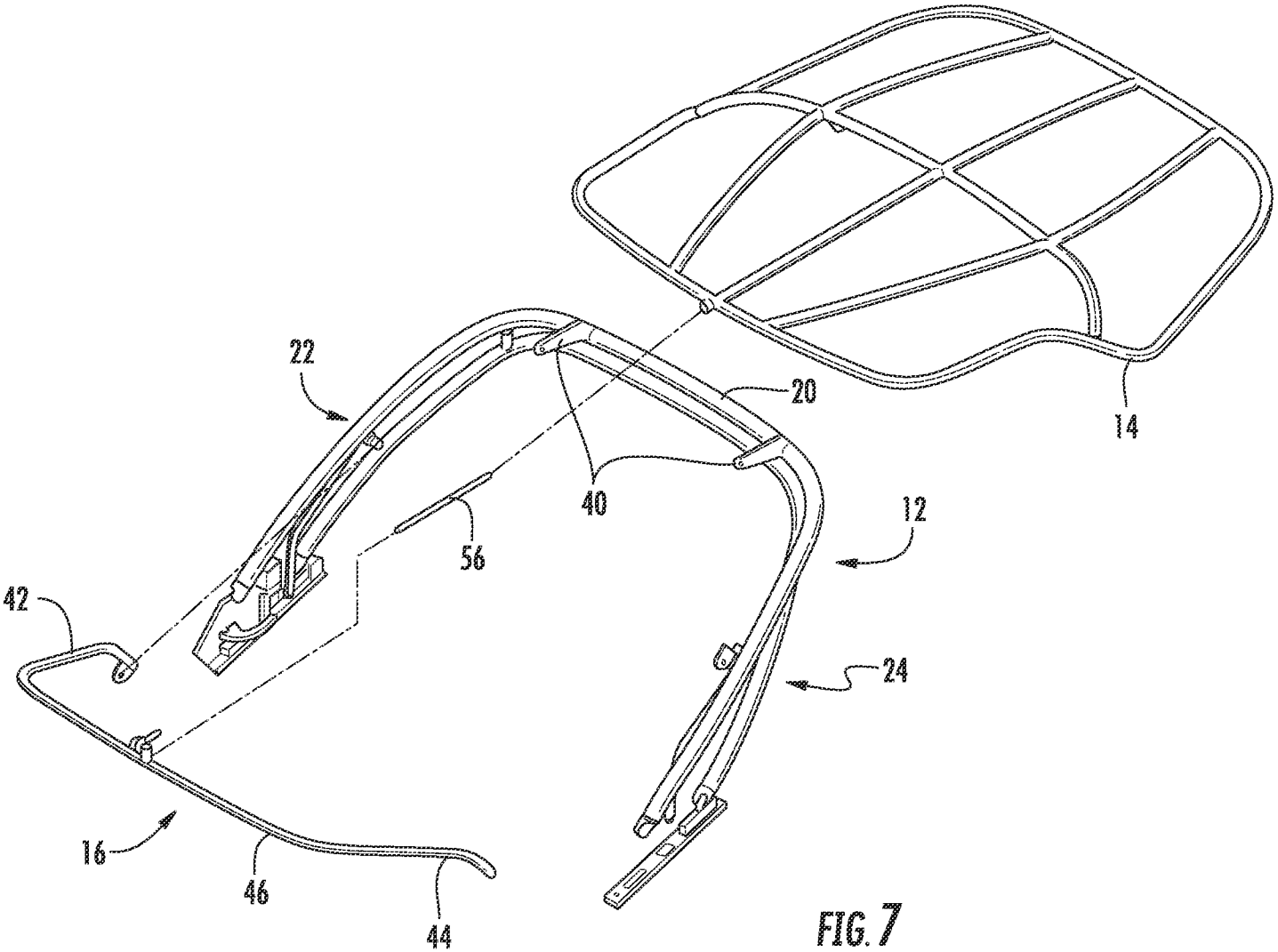

With initial reference to FIGS. 1-13, the disclosure relates to a folding arch system 10. The arch system 10 includes a folding rigid arch 12, a rigid canopy 14 supported by the arch 12, and a lateral support 16 connecting between the rigid arch 12 and the rigid canopy 14.

A significant aspect of the disclosure is that the arch 12 and the canopy 14 may be moved independently if desired, but move together, in unison, during lowering or raising of the arch system 10 between raised, intermediate, and lowered positions.

The folding rigid arch 12 has lowermost ends that connect to port and starboard extremities of a hull of a boat B. The folding arch member 12 provides a rigid arch shaped structure when erected and includes a crosspiece 20 extending between a pair of legs 22 and 24. The components of the arch 12 may be made of aluminum, composite, or other rigid materials. As shown, the arch 12 has a pair of arch members 26 and 28 secured to one another as by connectors or welding or the like to provide a unitary arch structure.

The arch 12 is generally configured in the shape of an arch mountable to the hull of the boat B so as to extend in a forward or bow direction, rising along its length, when in the fully erected orientation, such as shown in FIG. 1. The lowermost ends of the legs 22 and 24 are pivotally mounted relative to port and starboard extremities of the boat B. The legs 22 and 24 may be mounted directly to the boat B, such as to the deck or gunwales, as by hinge mounts and the like, or a base 30 may be mounted to each side of the boat B and each of the legs 22 and 24 mounted to one of the bases 30 in a manner to permit the arch 12 to be raised and lowered. As shown, the leg 22 has a forward portion pivotally mounted to the base 30 and an aft portion connected to a latch 31. The latch 31 is pivotally mounted to a forward portion of the base 30 and a rear portion of the latch is selectively latchable to the base 30 to lock the leg 32 to the base as desired. Thus, it will be understood that the legs may be pivotally mounted to a fixed base, or rigidly mounted to a base configured to release and be pivoted, or combinations thereof.

The base 30 is shown for the leg 22, but omitted for clarity of view of the leg 24. The base 30 as shown also desirably includes a lift assist device such as a spring or an electronic linear actuator 32 to assist in raising and lowering of the arch 12. The lift assist device is positioned to bear against the lower end of the leg 22 so as to urge it upwardly when the leg 22 is pivoted during raising of the arch 12, and to desirably resist movement of the leg 22 when the leg 22 is pivoted during lowering of the arch 12 so as to assist and control the rate of raising and towering of the arch 12. A lift assist device may be used with one or both of the bases. Also, the bases 30 may include locking structures to maintain the legs 22 and 24 at desired orientations.

The rigid canopy 14 may be provided as by a rigid sheet material or a rigid frame having a rigid or flexible sheet material located thereon, or removable or retractable panels for providing a desired sun protection. The rigid canopy 14 is configured to provide a roof-shaped structure over a cabin area C of the boat underlying the canopy 14.

A forward portion or a central portion of the canopy 14 is pivotally attached to the crosspiece 20 of the arch 12 with hinge connectors 40. A rear portion of the canopy 14 is supported by the lateral support 16, as explained more fully below.

The hinge connectors 40 and the lateral support 16 as connected to the canopy 14 permit the canopy 40 to remain in a substantially level or other predetermined orientation regardless of whether the arch 12 is raised or lowered. Thus, when the arch system 10 is in a raised position or in a lowered position or in an intermediate position, the canopy 14 remains in substantially the same horizontal orientation to provide a roof structure to overly and cover the cabin area C of the boat.

Figure 8:
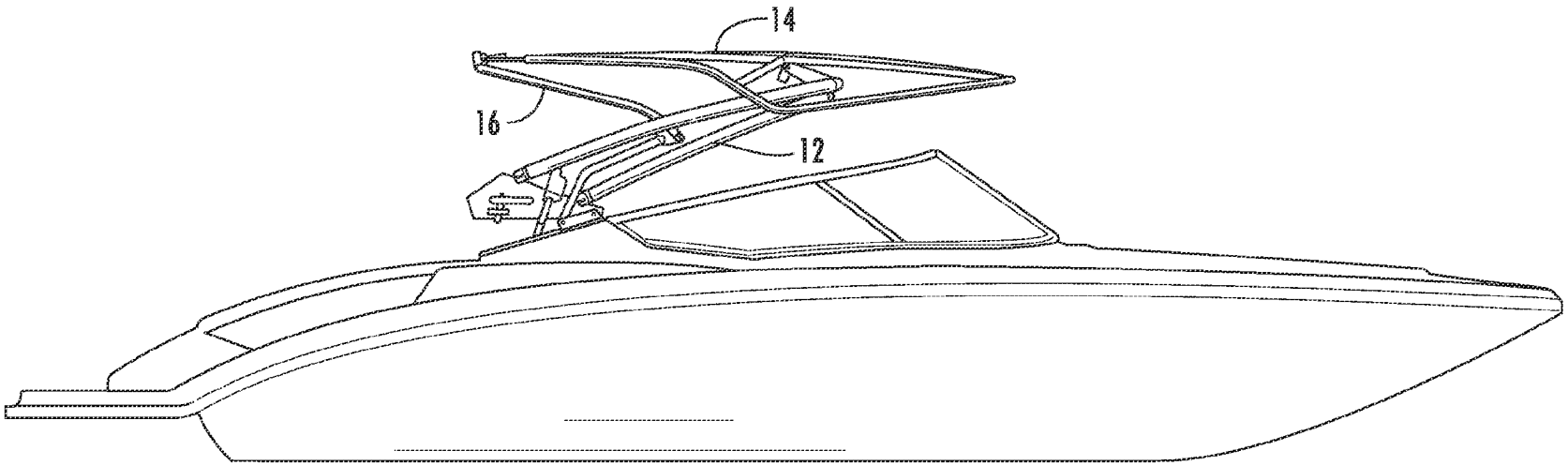
FIG. 8 shows the arch of FIG. 1 mounted on a boat hull and oriented in a middle position.
Figure 9:
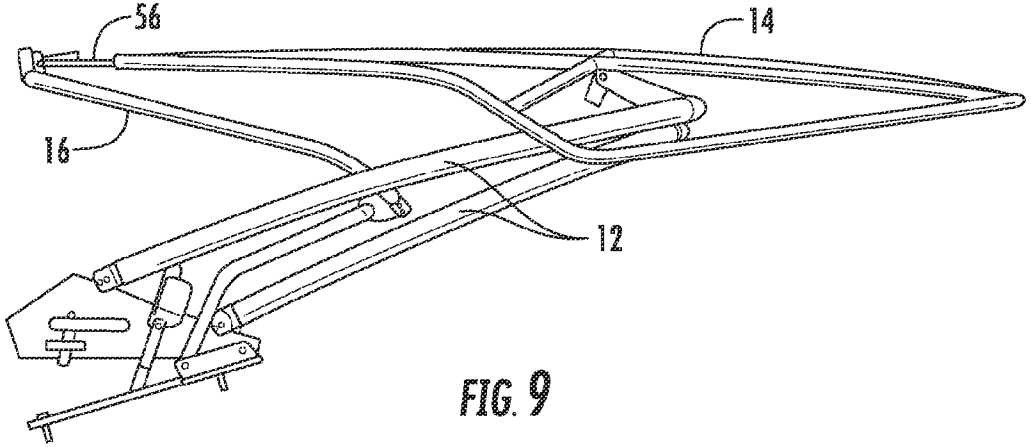
FIGS. 9 and 10 show the arch of FIG. 1 oriented in a middle position.
Figure 10:
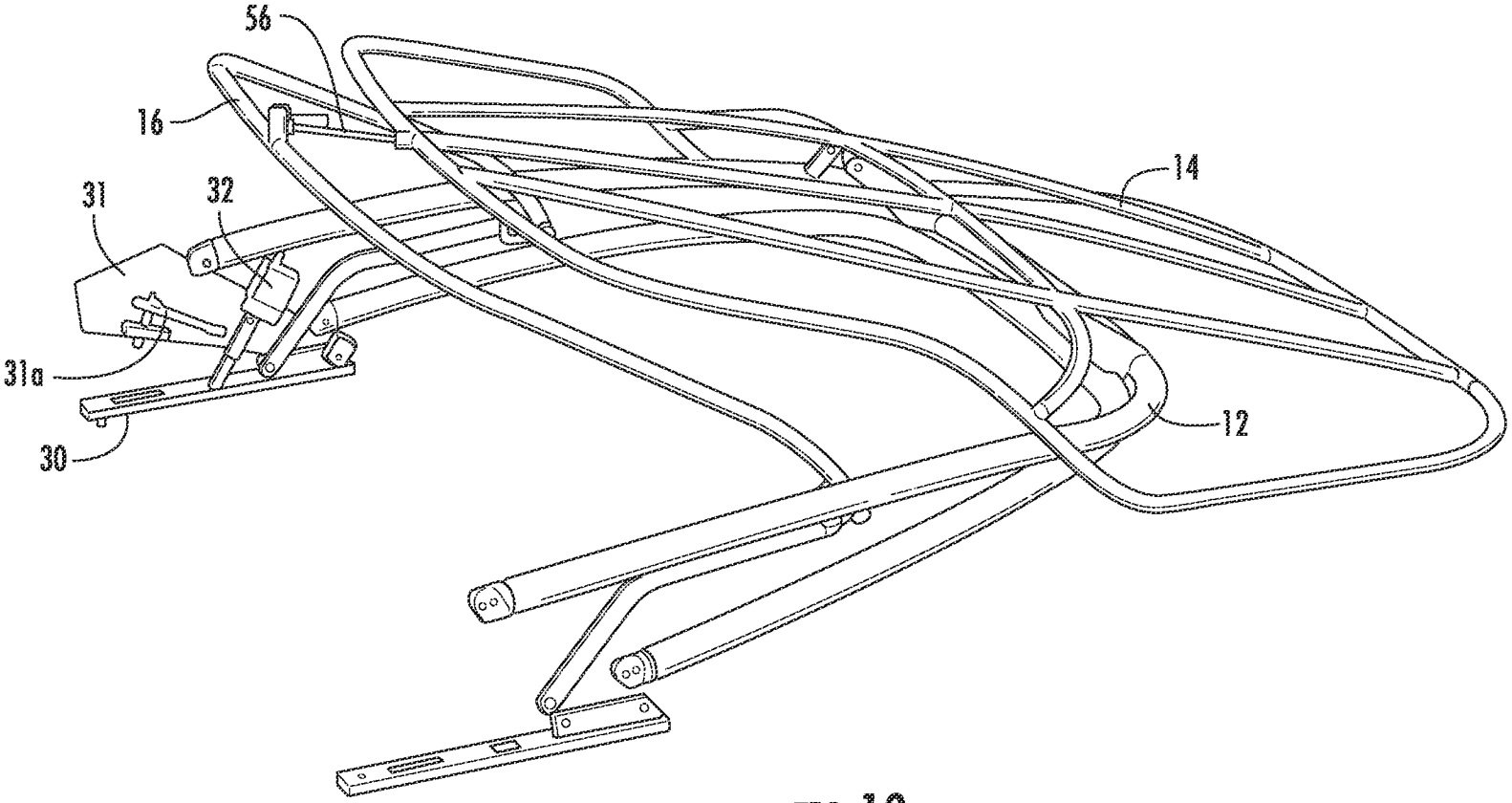
Figure 11:
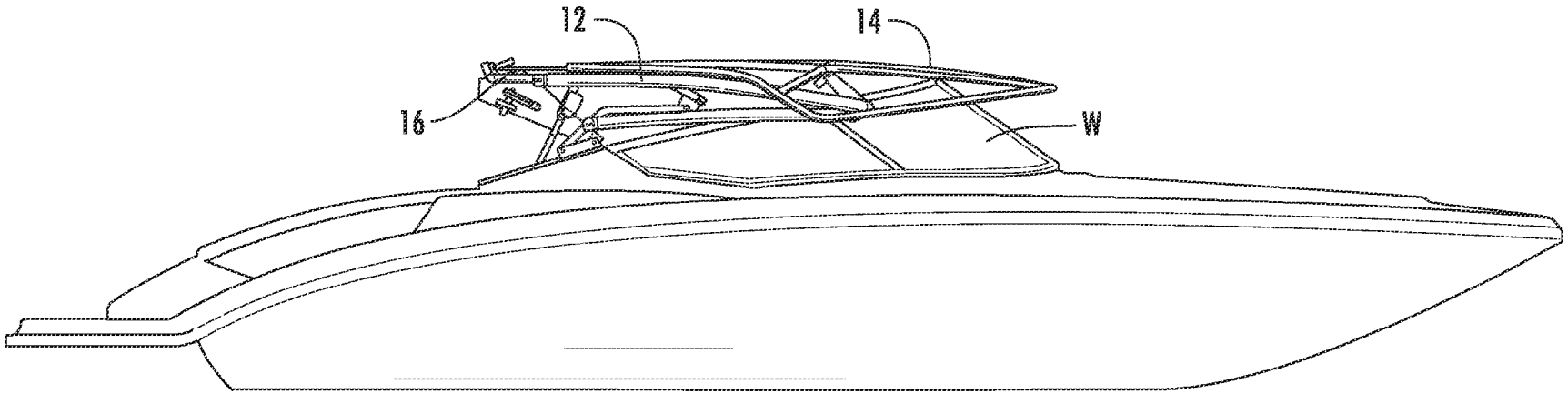
FIG. 11 shows the arch of FIG. 1 mounted on a boat hull and oriented in a low position.
Figure 12:
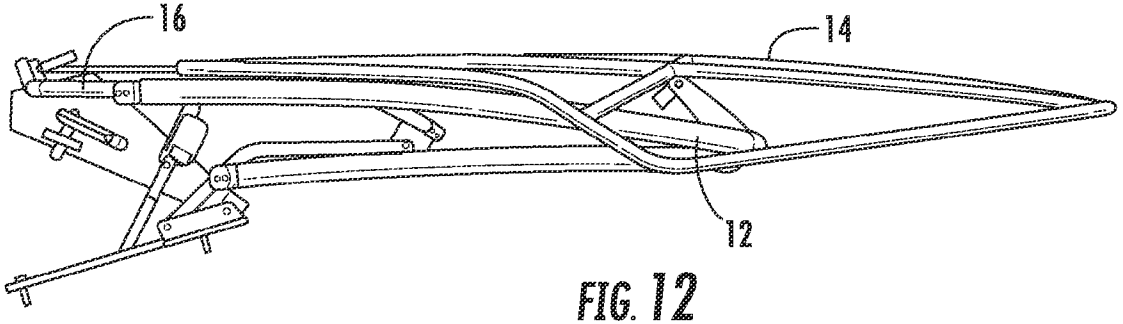
FIGS. 12 and 13 show the arch of FIG. 1 oriented in a low position.
Figure 13:
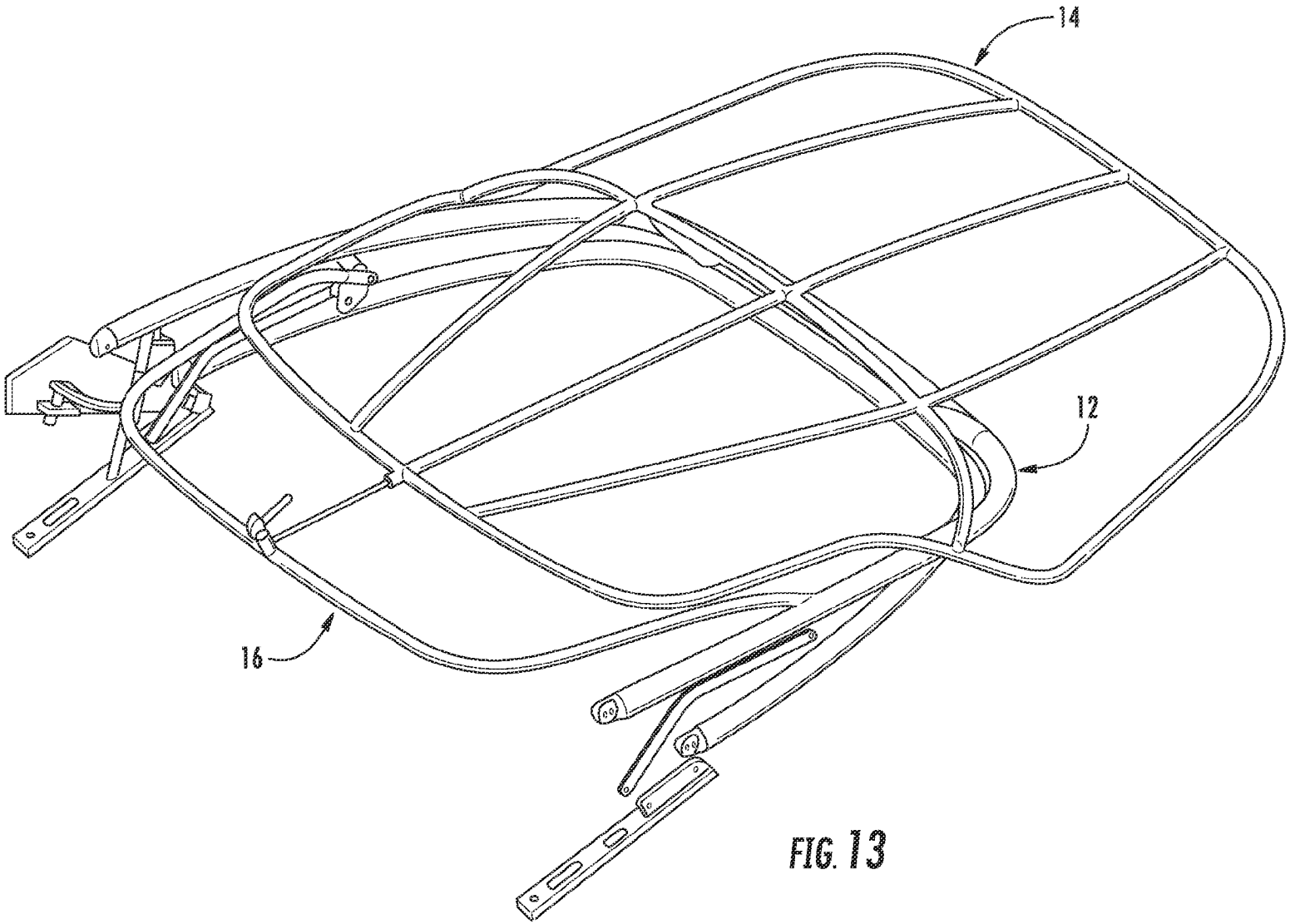

For example, FIG. 1 shows the arch system 10 in a fully raised orientation, FIG. 8 shows the arch system 10 in an intermediate position, and FIG. 11 shows the arch system 10 in a fully lowered position. In regard to FIG. 11, it will be appreciated that the arch system 10 enables the canopy 14 to extend over a windshield W of the boat B, capping the cabin C. This protection offered by the canopy 14 is particularly advantageous such as during storage, so as to protect the interior of the boat B from weather and debris.

The lateral support 16 is configured as an arch member having a pair of legs 42 and 44 pivotally mounted to the arch 12 and a crosspiece 46 connected to a rear portion of the canopy 14. The legs 42 and 44 of the lateral support 16 may be connected to the arch 12 as by attaching to the legs 22 and 24 of the arch 12, or to the bases 30 as by hinge mounts or the like. For example, a linkage 47 may connect the lateral support 16 to the arch 12 and the base 30, to control the position of the lateral support 16 relative to the canopy 14, as described below.

The crosspiece 46 of the lateral support 16 is connected to a rear or back portion of the canopy 14 so that as the arch raises, so does the crosspiece 46 and the canopy 14, with the canopy 14 remaining level, or at least substantially maintaining a constant orientation as it is raised or towered. That is, while the canopy 14 is preferably maintained level, it may be preferred in some instances that the canopy 14 remain in a desired slightly upward or slightly downward cant.

Accordingly, as the arch system 10 is raised or lowered, it is desired that arch 12 and the lateral support 16 move relative to one another in a scissor-like motion. Thus, the crosspiece 20 or other highest point of the arch 12 will remain in substantially the same vertical relationship with the crosspiece 46 or other highest point of the lateral support 16. Desirably, this is with the crosspieces 20 and 46 remaining substantially parallel and aligned. When the arch system 10 is in its lowest orientation, the crosspieces 20 and 46 will be at their greatest horizontal distance apart. When the arch system 10 is in its highest orientation, the crosspieces 20 and 46 will be at their least horizontal distance apart.

The lateral support 16 is movably or yieldably coupled to the canopy 14 to permit the described horizontal relative movement of the crosspieces 20 and 46. For example, with reference to FIG. 3, the lateral support 16 may be coupled to the canopy 14 by a traction spring assembly 50. The traction spring assembly 50 has a connector 52 attached to the canopy 14 and a connector 54 attached to the lateral support 16. A traction or pulling spring 56 of the spring assembly 50 extends between connector 52 of the canopy 14 and the connector 54 of the lateral support 16. The spring 16 assists in raising the arch system 10 from a lowered position. It also keeps the arch system 10 standing upright until the operator securely locks the arch system 10 in desired position. As the arch 12 raises or lowers, the linkage 47 synchronizes and controls the movement of the lateral support 16 so that the canopy maintains its horizontal orientations as the arch 12 is raised or lowered. For example, when the arch 12 is lowered, the linkage 47 moves the lateral support 16 away from the canopy 14, and as the arch 12 is raised, the linkage 47 moves the lateral support 16 toward the canopy 14.

The lateral support 16 and the canopy 14 may also include a cooperating locking structure to fixedly lock the canopy 14 to the lateral support 16 to maintain the arch system 10 in a given orientation. For example, a lock 58 may be provided as by slot 60 located through a surface toward the back of the canopy 14 configured to receive a connection member 62 from the lateral support 16. The slot 60 and connection member 62 come together and are locked together, as by a pin extending through the connection member 62 and the slot 60 or the like, to secure the arch 10 in the upright position. Alternatively, the spring assembly 50 may incorporate locking positions, in which case the lock 58 would not be necessary. Also, if desired, the spring assembly 50 may be replaced with an electric motor or linear actuator or the like to control the movement, and lock or fix the canopy 14 to the lateral support 16.

The lateral support 16 may be configured as one unitary structure, or as two separate portions, or just as a single half portion. While an arch structure is preferred for the lateral support 16, it will be understood that the lateral support 16 may be otherwise configured so as to connect to and pivot relative to the arch 12 and connect to a portion of the canopy 14 to support the canopy 14 as described herein.

Accordingly, as shown, the arch system 10 desirably provides a folding arch system for a boat having a rigid arch that may be raised and lowered, with a cooperating canopy pivotally connected to the rigid arch. A lateral support cooperates with the rigid arch and the canopy to enable the arch system to be raised and lowered, while maintaining the canopy at a substantially constant horizontal orientation as the arch system 10 is raised or lowered or situated at intermediate elevations. One significant benefit of this is the ability to position the canopy over the windshield and cabin of the boat, such as during storage. Further, both the arch and the canopy move in unison, during lowering or raising of the arch system 10 between raised, intermediate, and lowered positions.

Figure 14:
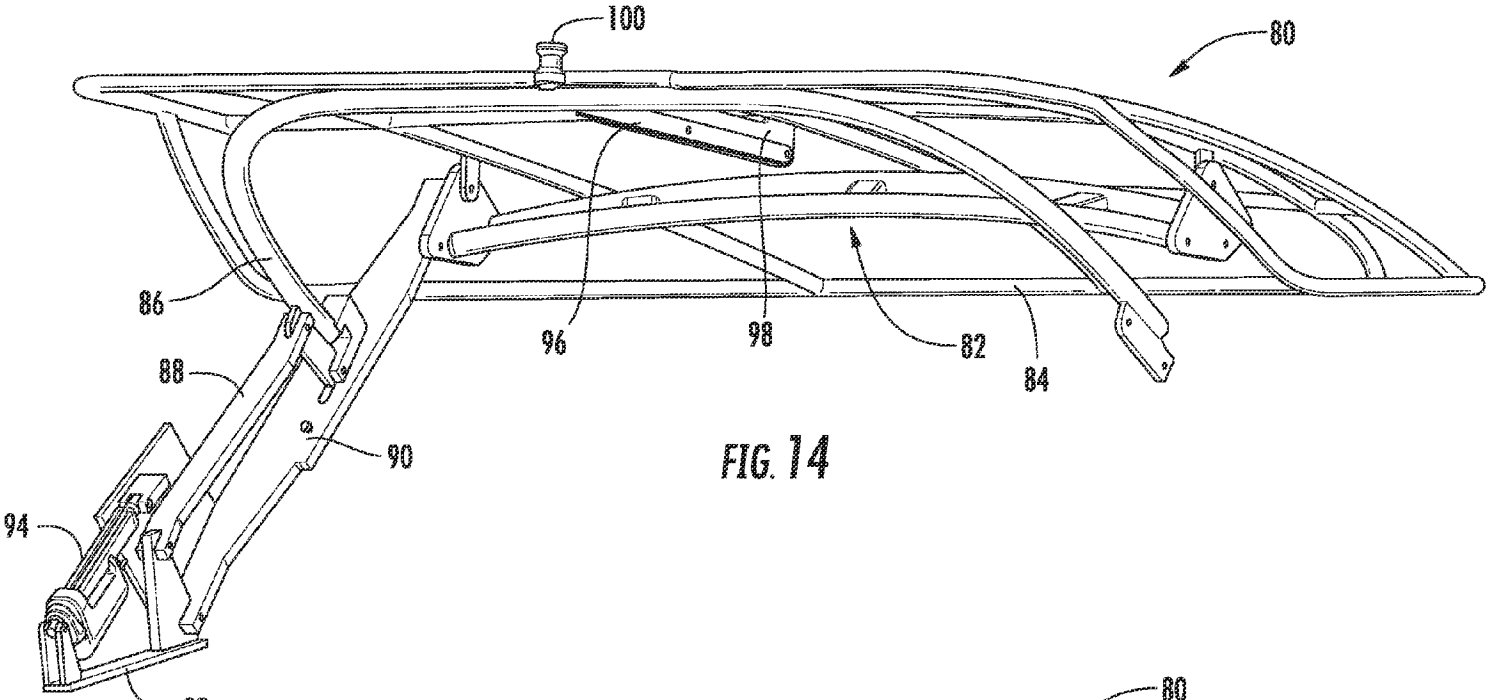
FIG. 14 shows an alternate embodiment of an arch according to the disclosure oriented in a high position.
Figure 15:
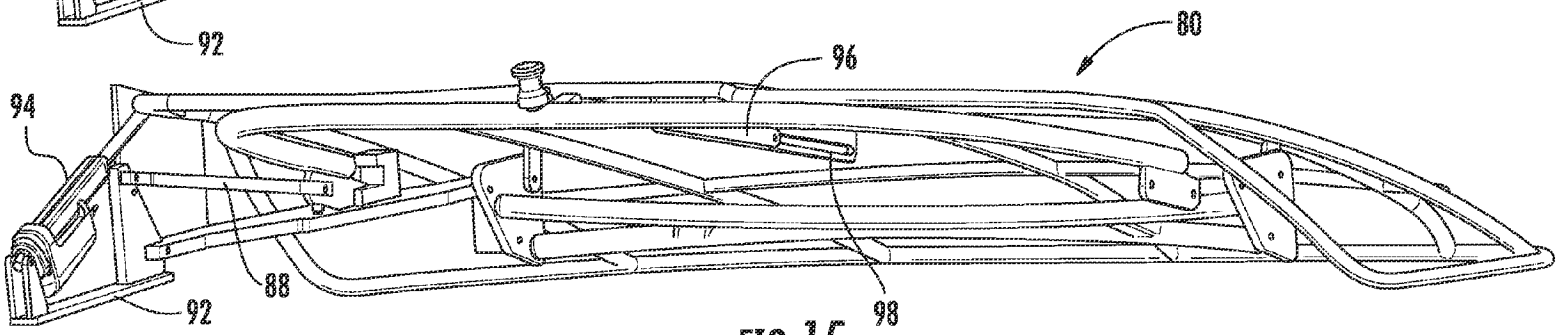
FIG. 15 shows the arch of FIG. 14 oriented in a low position.

Turning now to FIGS. 14 and 15, there is shown another embodiment of an arch system 80. The arch system 80 includes a folding rigid arch 82, a rigid canopy 84 supported by the arch 82, and a lateral support 86 pivotally connected to the rigid arch 82 by a linkage 88 and movably coupled to the rigid canopy 84. The arch system 80 folds and unfolds in a manner similar to the arch system 10. The linkage 88 functions similar to the linkage 47. Thus, as the arch 82 raises or lowers, the linkage 88 moves the lateral support 86 away from the canopy 84, and as the arch 82 is raised, the linkage 88 moves the lateral support 86 toward the canopy 84.

The rigid arch 82 is similar to the arch 12 and is generally arch shaped with a pair of legs and a crosspiece. A leg 90 is shown on one side, the leg on the opposite side being substantially the same but omitted for clarity of view of the leg 90. The leg 90 is shown having a base 92 for mounting the leg 90 to the boat. The base 92 includes an electric motor 94 having sufficient strength so as to effectively clamp or otherwise hold the arch system 80 at any desired orientation, from fully elevated to fully lowered.

The canopy 94 is substantially similar to the canopy 14. The lateral support 86 is configured as an arch member having a pair of legs pivotally mounted to the arch 92 and a crosspiece connected to a rear portion of the canopy 84. Due to the use of the motor 94 to move and clamp the arch system, the lateral support 86 does not utilize a lock or spring such as described for the arch system 10. A central portion of the lateral support includes an arm 96 that extends toward the canopy 84 and movably or telescopically mates within a guide 98 located on the canopy 84 to movably or yieldably couple the lateral support 86 to the canopy 84 to permit raising and towering of the arch system 80 in the manner described for the arch system 10. The lateral support 86 is also shown including a tow point 100 at central portion thereof for attachment of a ski rope for towing skiers and wakeboarders.

Figure 16:
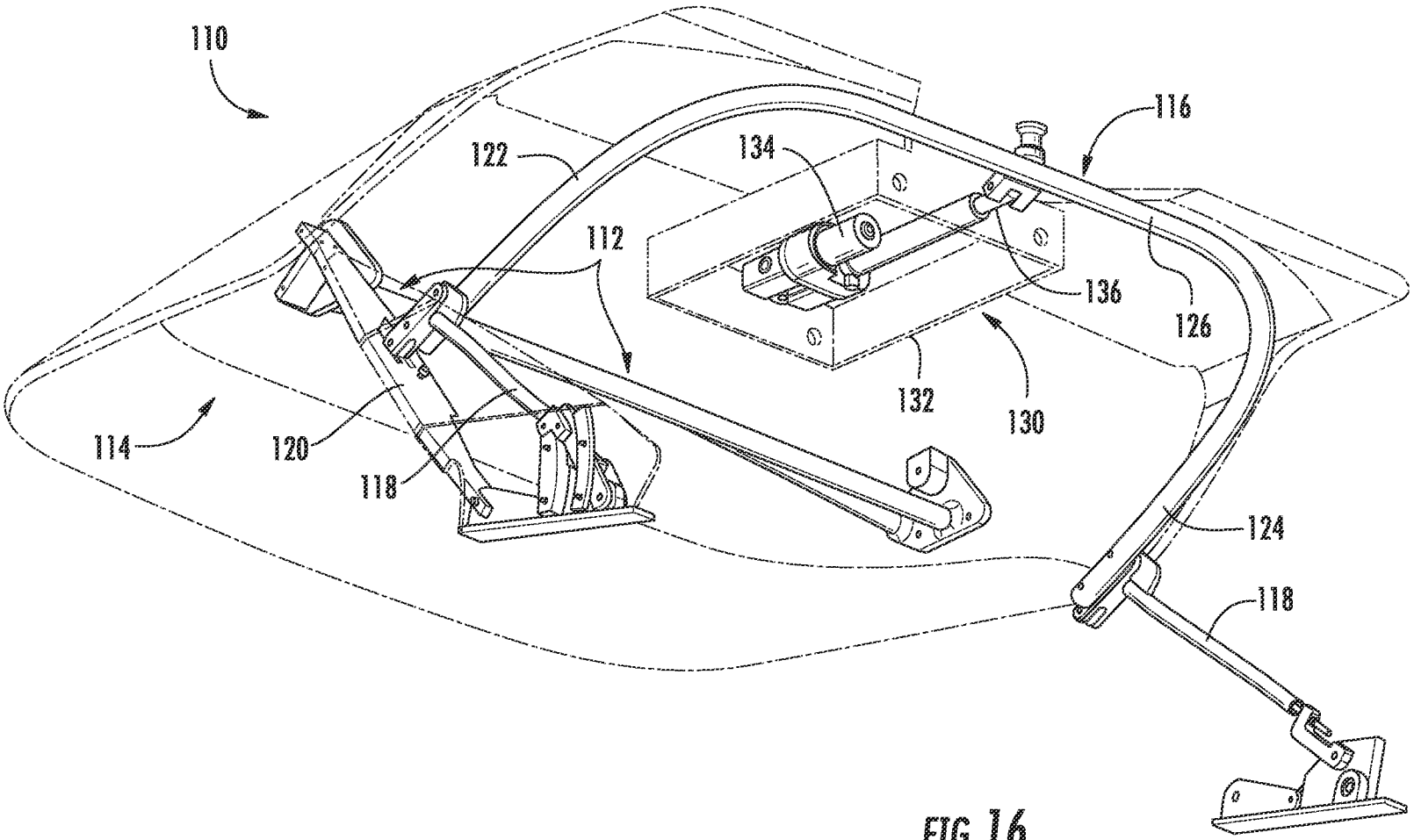
FIG. 16 shows a further embodiment of an arch according to the disclosure oriented in a high position.

With reference to FIG. 16, there is shown a further embodiment of an arch system 110. The arch system 110 includes a folding rigid arch 112, a rigid canopy 114 supported by the arch 112, and a lateral support 116 pivotally connected to the rigid arch 112 by a linkage 118 and movably coupled to the rigid canopy 114. The arch system 110 folds and unfolds in a manner similar to the arch system 10.

The rigid arch 112 is similar to the arch 12 and is generally arch shaped with a pair of legs and a crosspiece. A leg 120 is shown on one side, the leg on the opposite side being substantially the same but omitted for clarity of view of the leg 120.

The canopy 114 is substantially similar to the canopy 14. The lateral support 116 is configured as an arch member having a pair of legs 122 and 124 and a crosspiece 126 between the legs 122 an 124. The legs 122 and 124 are pivotally mounted to the arch 112, and the crosspiece 126 connects to a rear portion of the canopy 114. The lateral support 116 is pivotally connected to the arch 112 by the legs 122 and 124 and is movably positionable relative to rigid canopy 114 by a movable assembly 130. As shown, the movable assembly 130 includes a motor mount 132 fixedly mounted to the rigid canopy 114 and including an electric motor 134. An arm 136 connects between the motor 134 and the lateral support 116. The motor 134 operates to either extend or retract the arm 136 as the arch system 110 is lowered or raised. That is, when the arch system 110 is fully raised, the arm 136 is retracted its greatest extent. When the arch system 110 is fully lowered, the arm 136 is extended its fullest extent. The motor 134 is sufficiently strong to effectively lock the arch system 110 at its fully raised and lowered positions, as well as any intermediate position. The linkage 118 links the lateral support 116 to the arch 112, so that movement of the arch 112 and the lateral support 116 is synchronized to maintain the desired horizontal orientation of the canopy 114 as the arch 112 is raised or lowered.

Figure 17:
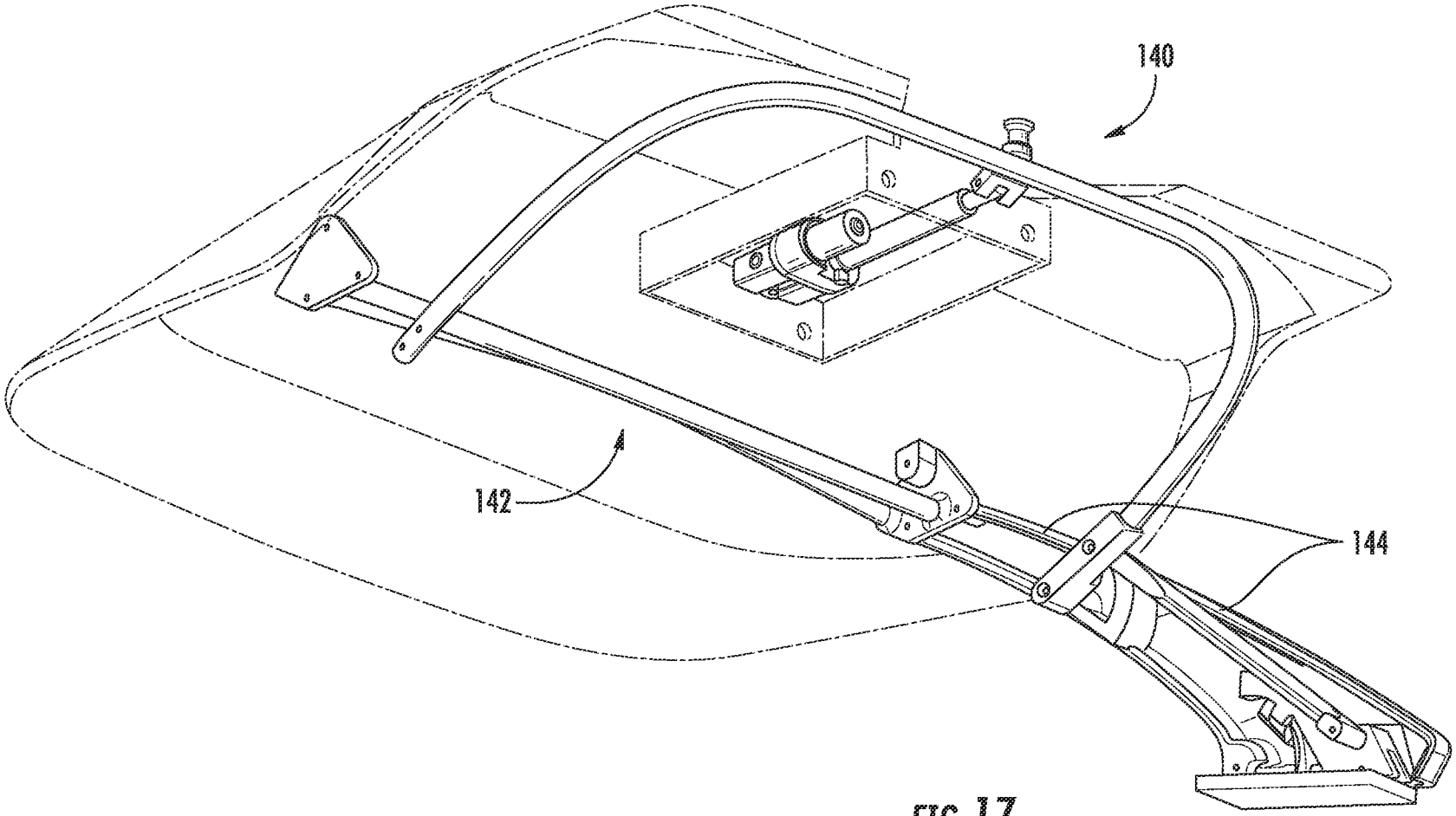
FIG. 17 shows yet another embodiment of an arch according to the disclosure oriented in a high position.

With reference to FIG. 17, there is shown another embodiment of an arch system 140. The arch system 140 is substantially similar to the arch system 110. However, as shown, the arch system 140 includes a rigid arch 142 having a leg 144 that is of cast construction and not tubular.

Accordingly, it will be appreciated that arch systems according to the disclosure advantageously enable arch systems that enable a folding rigid arch and a rigid canopy to be moved vertically together in unison. The arch systems also advantageously maintain the canopy in a substantially uniform horizontal orientation as the arch system is raised or lowered or situated at intermediate elevations.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A folding arch system for a boat, the folding arch system comprising:

an arch member pivotally connected to a boat and pivotally positionable relative to the boat between a raised position and a lowered position;

a lateral support pivotally connected to the arch member; and a rigid canopy pivotally connected to the arch member and yieldably coupled to the lateral support such that the rigid canopy can move towards and away from the lateral support while maintaining a coupling with the lateral support and a connection with the arch member and while the lateral support maintains a connection with the arch member, wherein the arch member and the lateral support supportably position the rigid canopy in a predetermined horizontal orientation, wherein the arch system is raised by raising the arch member and lowered by lowering the arch member, and wherein the rigid canopy maintains its connection to the arch member and its coupling to the lateral support as the arch system is raised and lowered such that the canopy is substantially maintained by the arch member and the lateral support in the predetermined horizontal orientation when the arch system is in a raised orientation, a lowered orientation, and orientations there between.

2. The folding arch system of claim 1, further comprising an electric motor configured for raising and lowering the arch system, the motor being connected to the arch member.

3. The folding arch system of claim 1, further comprising an electric motor configured for raising and lowering the arch system, the motor being connected between the rigid canopy and the lateral support.

4. The folding arch system of claim 1, further comprising a spring configured for assisting in raising and lowering the arch system, the spring being connected between the rigid canopy and the lateral support.

5. The folding arch system of claim 1, wherein the boat on which the folding arch system is installed includes a windshield, and when the folding arch system is orientated in the lowered orientation, the canopy extends over the windshield so as to cover and protect an underlying interior of the boat.

6. A folding arch system for a boat, the folding arch system comprising:

an arch member comprising two legs and a cross member, the arch member pivotally connected to a boat and pivotally positionable relative to the boat between a raised position and a lowered position;

a lateral support pivotally connected to one of midsections of the legs of the arch member or base members adjacent ends of the legs of the arch member; and a rigid canopy coupled to the arch member and coupled to the lateral support, wherein the arch member and the lateral support supportably position the rigid canopy in a predetermined horizontal orientation, wherein the arch system is raised by raising the arch member and lowered by lowering the arch member, and wherein the rigid canopy maintains its coupling to the arch member and its coupling to the lateral support as the arch system is raised and lowered such that the canopy is substantially maintained by the arch member and the lateral support in the predetermined horizontal orientation when the arch system is in a raised orientation, a lowered orientation, and orientations there between.

7. A folding arch system for a boat, the folding arch system comprising:

an arch member comprising two legs and a cross member, the arch member pivotally connected to a boat and pivotally positionable relative to the boat between a raised position and a lowered position;

a lateral support pivotally connected to one of midsections of the legs of the arch member or base members adjacent ends of the legs of the arch member; and a rigid canopy pivotally coupled to the cross member of the arch member and yieldably coupled to the lateral support such that the rigid canopy can horizontally move towards and away from the lateral support while maintaining a coupling with the lateral support, wherein the arch member and the lateral support supportably position the rigid canopy in a predetermined horizontal orientation.

* * * * *